US007540174B2

(12) United States Patent
Snijders

(10) Patent No.: US 7,540,174 B2
(45) Date of Patent: Jun. 2, 2009

(54) METHOD AND APPARATUS FOR CIRCULAR KNITTING WITH ELASTOMERIC YARN THAT COMPENSATE FOR YARN PACKAGE RELAXATION

(75) Inventor: Jacobus-Michiel-Hubertus Snijders, Maastricht (NL)

(73) Assignee: INVISTA North America S.ar.l., Wilmington, DE (US)

( * ) Notice: Subject to any disclaimer, the term of this patent is extended or adjusted under 35 U.S.C. 154(b) by 362 days.

(21) Appl. No.: 11/109,381

(22) Filed: Apr. 19, 2005

(65) Prior Publication Data

US 2006/0242999 A1 Nov. 2, 2006

(51) Int. Cl.
*D04B 15/44* (2006.01)

(52) U.S. Cl. ..... 66/146

(58) Field of Classification Search ..... 66/8, 66/125 R, 136, 146, 132 R
See application file for complete search history.

(56) References Cited

U.S. PATENT DOCUMENTS 4,651,938 A 3/1987 Memminger et al.
4,673,139 A * 6/1987 Memminger et al. ..... 66/210
5,050,405 A * 9/1991 Jacobsson ..... 66/132 R
5,454,151 A 10/1995 Bogucki-Land et al.
6,094,945 A * 8/2000 Lonati et al. ..... 66/146
6,105,398 A * 8/2000 Leins et al. ..... 66/132 R
6,810,694 B2 * 11/2004 Wallis ..... 66/8
6,901,776 B2 * 6/2005 Wallis ..... 66/8
7,117,695 B2 * 10/2006 Laycock et al. ..... 66/198
2004/0195426 A1 10/2004 Lock

FOREIGN PATENT DOCUMENTS

| | | |
|---|---|---|
| EP | 0744483 | 11/1996 |
| EP | 0933457 | 8/1999 |
| WO | WO9532140 | 11/1995 |
| WO | WO03085183 | 10/2003 |

OTHER PUBLICATIONS

European Search Report for EP06252087.

* cited by examiner

*Primary Examiner*—Danny Worrell
(74) *Attorney, Agent, or Firm*—Christina W. Geerlof

(57) ABSTRACT

When elastomeric yarns are unwound and fed to the needles of a circular knitting apparatus, a yarn package relaxation profile is set, or determined, with corresponding adjustments made to the unwinding speed based on such package relaxation profile. Variably compensating for a varying package relaxation while knitting results in more uniform properties in a circular knit fabric and improved elastomeric yarn yield.

14 Claims, 2 Drawing Sheets

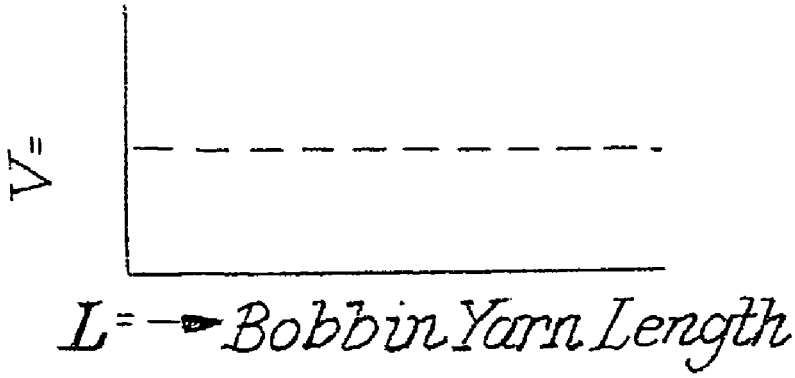
Fig. 2 (Prior Art)
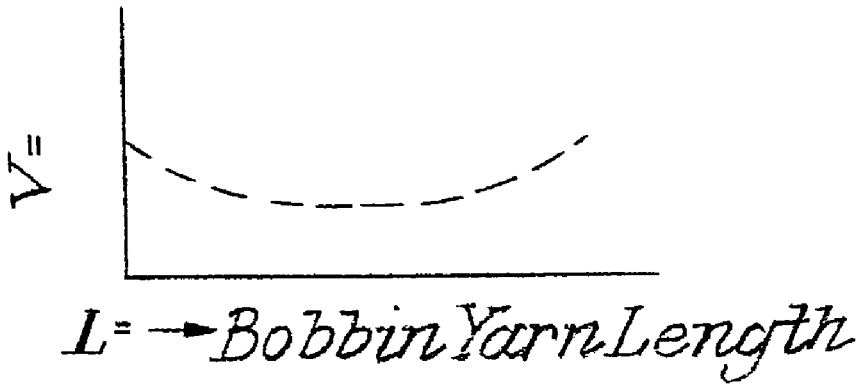
Fig. 3.
Fig. 4 (Prior Art)
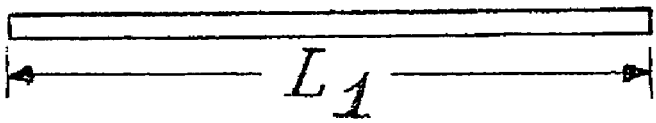
Fig. 5 (Prior Art)
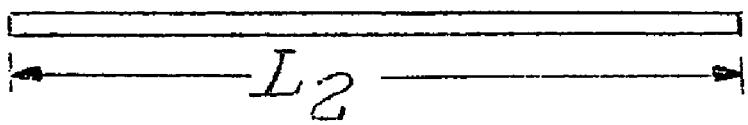

METHOD AND APPARATUS FOR CIRCULAR KNITTING WITH ELASTOMERIC YARN THAT COMPENSATE FOR YARN PACKAGE RELAXATION

BACKGROUND OF THE INVENTION

1. Field of the Invention

The present invention relates to elastomeric yarn knitting where yarn packages in a creel are unwound and presented to a circular knitting machine. The present invention also relates to computer-controlled feeding systems that compensate for the variable package relaxation or unwind tension level of elastomeric bobbins.

2. Description of the Related Art

Elastomeric yarn is stored, by winding yarn onto a tube to form a cake or bobbin, sometimes referred to as a yarn "package." Elastomeric yarn typically comprises a continuous filament that has a break elongation in excess of 100% and which, when stretched and released retracts quickly and forcibly to substantially its original length. Such fibers include, but are not limited to, rubber, polyether polyester, and any elastane such as Lycra® or Elaspan®. Elastomeric yarn may have these stretch fibers covered with other, non-elastomeric fibers, sometimes called "hard yarn" or "companion yarn," such as cotton or nylon.

Elastomeric yarns are typically spun at high speeds and stretched during winding in order to build a stable package and to guarantee that the wound yarn will not fall off of the tube. This process can leave residual tension within the bobbin. A given length of elastomeric yarn may have a relaxed length L1 as schematically shown in FIG. 4. As the yarn is wound it elongates to length L2 (i.e. L2>L1) as schematically shown in FIG. 5. When the yarn is taken off the package, the same given amount of the wound yarn relaxes and returns to a relaxed length L1 as shown in FIG. 4.

For example, an elastomeric yarn bobbin may have an outside yarn circumference of 25 cm. Four revolutions of the stretched yarn on the outside layers of the package would have a stretched length L2 of 25×4=100 cm. When unwinding four revolutions of the package and relaxing the thread line to zero tension, the final unwound length L1 is less than 100 cm, such as, for instance, 90 cm. The package relaxation percentage can be expressed by the equation:

$$PRL\%=((LS-LR)/LR)\times 100\%$$

In this equation, LS is the stretched length, LR is the relaxed length and the PRL is the package relaxation (PRL), which is expressed as a percentage. The package relaxation of the yarn on the bobbin in this example is calculated as: ((100−90)/90)×100%=11.1%. The amount of relaxation that occurs with any given amount of the yarn as the yarn is wound is not necessarily constant. Thus, there is a need to accommodate the package relaxation when processing a given material.

Machines for warping or beaming of elastomeric bobbins have been adapted to compensate for the package relaxation of a given elastomeric yarn. One conventional beaming apparatus includes a creel with elastomeric yarn packages positioned on and driven by drive rolls. The creel can contain 1100-1500 bobbins, the threadlines of which are unwound simultaneously onto big metal beams. The yarn is fed as one threadsheet comprised of individual thread lines. Normally, three, six or even nine beams are created from one creeling of elastomeric bobbins. The beams are typically used in a warp knitting machine as a set. For example, a set of three beams of elastomeric material may be combined with a set of three beams of nylon hard yarn to knit an elastified fabric. The characteristics of the beams within one set should be identical. Otherwise, the weight and circumference variation among the individual beams will lead to unacceptable tension-variations within the knitted fabric. Adjusting the creel speed or the beam speed based upon an assumed or actual package relaxation profile within the bobbin reduces of prevents these variations. Therefore, compensation of package relaxation is a basic requirement in warping, and is done automatically while unwinding elastomeric bobbins.

Currently, circular knitting machines and techniques do not compensate for package relaxation of elastomeric yarn bobbins.

Circular knitting of elastified fabrics usually requires a number of bobbins of elastomeric yarn in the creel of the machine. Circular knitting machines are well known in the art and can typically handle from a few bobbins up to 144 elastomeric bobbins. The majority of known circular knitting machines that are used handle 48 to 96 bobbins.

A majority of the devices used for unwinding the individual bobbins in circular knitting machines are "Fournisseure" type elastomeric rollers, such as the MER-2 from Memminger-IRO Gmbh of Dornstetten, Germany. The MER-2 can hold and run one to four elastomeric yarn bobbins. The bobbins of elastomeric yarn are surface driven on two small metal drive rolls. The unit itself is connected to a narrow, centrally-driven belt.

One manner of adjusting the speed of the drive belt in Fournisseure-type rollers is by adjusting the diameter of a belt in an expandable pulley, also known as a quality adjustment pulley or quality wheel. Expandable pulleys are well known and typically have a top and bottom ring or disk with which may have at least one graduated inside surface or other means for moving a belt in an axial direction. Turning the disks will position them closer or further from each other, which forces the belt to move along the axis of the pulley. For example, as the disks are moved toward each other, the belt is forced outward along the radius of the disks which increases the gauge, i.e. the diameter of the belt in the expandable pulley. Normally, a single known gauge is used for a particular circular knitting machine and/or for a particular fabric style. The pulley, which is driven by a central motor of the circular knitting machine, turns a belt that, in turn, turns the unwinding device or devices.

Traditional circular knitting machines often have a single central motor that drives a dial, a fabric take-off roll, and a number of yarn feeder systems. The dial registers and presents the yarns from the bobbins to knitting operation positions. One belt and pulley system drives the yarn feeder systems that feed the elastomeric yarn off of the elastomeric roller. The expandable pulleys are adjusted to one fixed setting for a specific fabric style or quality and, therefore, no corrections are ever made for the package relaxation profile.

Several circular knitting machine manufacturers have replaced expandable pulleys with small and independent computer controlled brushless motors or step motors to control the speed of the drive belts in the creel. A large motor drives the dial with the needles and the fabric take-off roll. Small separate motors drive the belts that directly run the individual take-off devices for the elastomeric yarns and, in some cases, the companion yarns. However, the yarn feed velocity is still set at one fixed speed setting within one particular creeling of elastomeric bobbins or fabric style.

The effect of package relaxation on the final circular knit product has not been well understood within the art. Knitting tension measurements may be performed, but are not always accurate as they are typically performed at only a few positions (typically 2-4 positions). Apart from the accuracy of the applied tension device, the tension varies from position to position on the circular knit machine and may be caused by variations in the elastomeric yarn or the circular knit machine. The measured data is not reliable because often only a few measurements are performed at only a few locations.

Additionally, measurements and quality checks in circular knitting are conventionally done only when starting up a creel of full bobbins. Fabric knitters and fabric manufactures do not perform measurements during knitting or after finishing each and every fabric roll that is being made on one creeling of elastomeric yarn bobbins.

A measurement computer, such as the LMT6 manufactured by Memminger IRO GmbH of Dornstetten, Germany, can be used at the start up of the circular knitting process to measure the speed at which the yarn is fed. The LMT6 is programmed with a package relaxation level (typically based on only one data point and only from the outside layers of the elastomeric yarn bobbin). For example, an LMT6 user often applies one assumed package relaxation value of, for example, 10% for all elastomeric yarns. This assumed value fails to account for variations in the package relaxation profiles between elastomeric yarn decitexes, between different package sizes from one yarn supplier to the other, and between packages from the same supplier. Furthermore, no compensation is made for the package relaxation profile within one bobbin of elastomeric yarn as it is unwound. The LMT6 then performs predetermined calculations and prints the data. The LMT6 measurement computer, however, does not control the drive systems of the circular knitting machines.

The elastomeric yarn content data that is generated by the LMT6 device is typically based on measurements performed only at the start-up of each knitting process. The speeds of the various motors on the circular knit machine are set to a constant value. Any variation in the package relaxation during unwinding is not considered, and is therefore left uncompensated.

Failing to compensate for the relaxation profile of each bobbin of elastomeric yarn in circular knitting can lead to fabrics of varying characteristics and lower quality. Methods and equipment to determine and compensate for the package relaxation profile of an elastomeric yarn in a circular knitting machine would overcome these deficiencies.

SUMMARY OF THE INVENTION

One embodiment of the invention comprises a method and apparatus for circular knitting that compensates for the variable package relaxation within elastomeric yarn bobbins. Such compensation provides more constant tension during unwinding of the bobbin resulting in fabric with more constant elastomeric yarn content, better yield of the expensive elastomeric yarn, and more constant fabric quality parameters, such as fabric width and fabric weight.

Compensation is achieved utilizing a system that adjusts the speed at which the elastomeric yarn is fed based on the-package relaxation profile of the elastomeric yarn packages. The adjustments necessary to maintain constant tension define that bobbin's compensation profile.

The compensation profile can be based on a known or assumed package relaxation profile for a given elastomeric yarn material. Alternatively, the compensation profile can be determined by monitoring the yarn as it is unwound or fed. Still alternatively, the compensation profile can be based on data collected while winding the elastomeric yarn on the bobbin tube during elastomeric yarn production.

Those skilled in the art will appreciate the above stated advantages and other advantages and benefits of various embodiments of the invention upon reading the following detailed description of the embodiments with reference to the below-listed drawings.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 2 is a graph of the constant velocity at which the elastomeric yarn is fed in related art circular knitting;

FIG. 3 is a graph showing a compensation profile according to the present invention, which illustrates how the velocity at which the elastomeric yarn is fed is altered to achieve more constant elastomeric yarn content in the elastified fabric;

FIG. 4 schematically illustrates a given length L1 of relaxed elastomeric yarn;

FIG. 5 schematically illustrates how the elastomeric yarn of FIG. 4 is elongated to length L2 as it is wound on a bobbin.

DETAILED DESCRIPTION OF THE PREFERRED EMBODIMENT

Figure 1:
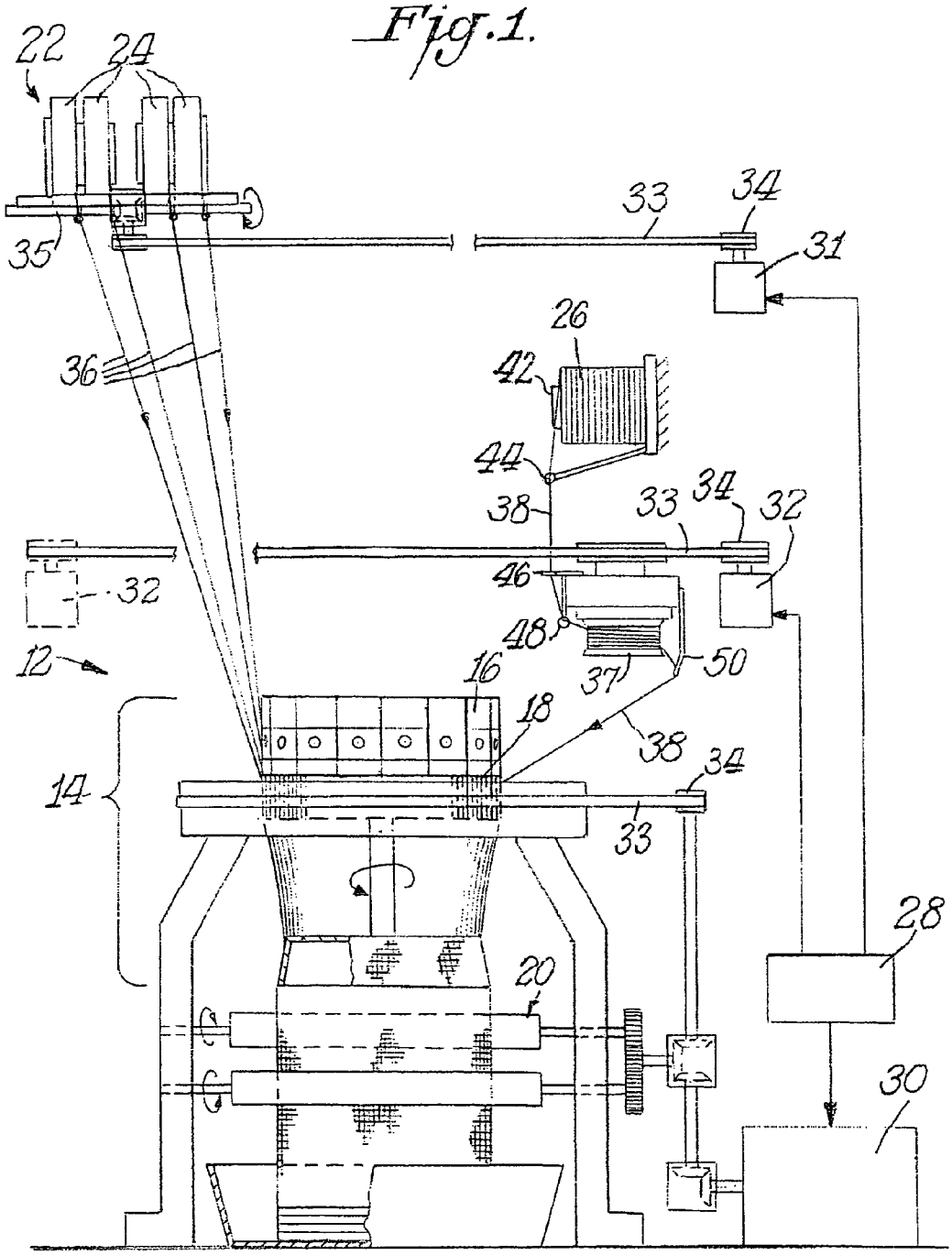
FIG. 1 schematically illustrates a side elevational view of a circular knitting apparatus according to a preferred embodiment of the invention.

A circular knitting apparatus and method will now be described with reference to FIG. 1, which shows a Memminger MER-2 device 22 as discussed above and available from Memminger-IRO Gmbh of Dornstetten, Germany. Knitting apparatus 12 includes a knitting portion 14 with a dial 16 and needles 18 associated with the dial 16, a fabric take-up roll portion 20 at the bottom of the apparatus, a creel portion 22 including elastomeric yarn bobbins 24 and companion yarn bobbins 26, and a computer 28.

Computer 28 controls motor 30 for driving the dial, the fabric roll take-up roll portion, step motor(s) 31 for the elastomeric yarn bobbins, and step motor(s) 32 for the companion yarn bobbins. The motor 30 drives the dial using a series of belts 33 and pulleys 34. Alternatively, gears, pulleys, or other mechanical means could be used. The speeds of the various motors of a circular knitting apparatus are traditionally set to constant values throughout the knitting process as represented graphically in FIG. 2. The Y-axis represents the velocity of the motors, and the X-axis represents the length of the elastomeric yarn on a bobbin. FIG. 2 illustrates that the speed of unwinding the elastomeric yarn is typically held constant, similar to the other various systems in the circular knitting apparatus.

Motor 31 can drive a system of drive belts 33 and pulleys 34 according to well known techniques to turn surface rollers 35. Multiple motor systems may be used to turn the surface rollers of other bobbins (not shown) as is well known in the art of circular knitting. Surface rollers 35 turn elastomeric bobbins 24 to unwind elastomeric yarn 36. Although the bobbins 24 are preferably unwound using surface driven take-off as shown in FIG. 1, the yarn take-off from the bobbins can also be over end take-off or driven take-off. The driven take-off system is also called a touchless system because the bobbin is fixed to a chuck that turns the bobbin to unwind the bobbin without touching the yarn. Elastomeric yarn 36 is then fed through needles 18 in the direction indicated in FIG. 1.

Motor 32 can drive a system of belts and pulleys according to well known techniques, as described above with respect to motor 31, to unravel companion yarn 38 from bobbin 26 and feed it through needles. 18. Additionally, as with the elastomeric yarn 36, multiple motors 32 such as shown in phantom in FIG. 1 may be used to feed the non-elastomeric companion yarn 38. A belt 33 turns a hard yarn feeder 37 for companion yarn 38. The feeder's turning motion pulls companion yarn 38 from the bobbin 26, which is situated on a creel 42, through a series of eye guides 44, 46 and 48. Thus, multiple yarns may be fed from a creel according to the over end take off method. Although bobbin 26 is illustrated proximate to the main body of the circular knitting apparatus 12 in FIG. 1, the bobbin 26 may be located on a creel rack (not shown) distanced from the circular knit machine 12.

Central motor 30 drives needles 18 that pull the companion yarn 38 through eye guide 50 to be knit with the elastomeric yarn 36. Upon knitting, finished fabric is then presented to take up roll 20, fed through rollers and rolled, folded or wrapped for future use. If the speeds of all the motors or drive systems are maintained constant, the companion yarn content in the finished fabric will be constant, while the elastomeric yarn content in the finished fabric will vary due to package relaxation. Thus, independently adjusting the unwinding speed of the elastomeric yarn will compensate for the package relaxation to yield a fabric with consistent elastomeric yarn content.

Motors 30, 31, and 32 may be independently controlled with computer 28 to vary or adjust the speed at which the elastomeric yarn bobbins 24 are unwound relative to speed of the dial 16 and the unwinding speed of the companion yarn bobbins 26. The motors can be controlled manually or by using multiple computers. Roller speeds can be adjusted at predetermined intervals or continuously.

The circular knitting apparatus 12 alternatively can be equipped with expandable pulleys (not shown) connected to belt 33 rather than individual brushless or step motors. The dial 16, the fabric take-up roll portion 20, surface rollers 35 and positive feeder 37 each can be associated with an expandable pulley. The expandable pulley(s) can replace pulleys 34 and step motors 31 and 32, can be connected directly to a central motor 30 and can be independently adjusted throughout the knitting process by adjusting the diameter of the belt in the expandable pulley. Adjusting the diameter of the belt in the expandable pulley according to well known techniques, as discussed above, will change the drive belt speed. Adjustments can be performed manually and conducted, for instance, about 10 to 50 times during unwinding.

Adjusting the diameter of the belt in the expandable pulley associated with the elastomeric yarn allows one to control the elastomeric yarn content in the finished fabric using a statistical regression analysis. For example, in the circular knitting apparatus, the diameter of the drive belt in the expandable pulley is linearly related to the speed of the drive belt, which is linearly related to the drive roll speed of the Memminger MER2 (described above) unwinding the elastomeric yarn, which is linearly related to the circumferential speed of the elastomeric yarn package, which is linearly related to the elastomeric yarn content in the fabric. This linearity results from the fact that the expandable pulley turns the belt that drives the Memminger MER2. Thus, if the gauge of the expandable pulley is set 10% higher, the speed of the drive belt in the expandable pulley should increase by 10%, the drive roll speed of the Memminger MER2 should increase by 10 %, and thus, the elastomeric yarn content should increase by about 10%. More importantly, adjusting the expandable pulley adjusts the speed at which the elastomeric yarn is, unwound independently from the unwinding speed of the hard or companion yarn. This allows a user to adjust the unwinding speed of the elastomeric yarn to compensate for package relaxation, while maintaining a constant unwinding speed for the hard or companion yarn. By making the above or similar adjustments, the unwinding speed of the, elastomeric yarn can be adjusted throughout the process to obtain a fabric with a more constant or consistent elastomeric yarn content.

The adjustments, whether made using expandable pulleys or motors, may be made based on 1) a known compensation profile, 2) measurements made during the knitting process, or 3) a mass database created when the yarn was spun onto the bobbin during yarn manufacture. As shown in FIG. 3, the speed ("v") at which the elastomeric yarn is unwound can be adjusted throughout the process of unwinding a bobbin. The package relaxation profile shown in FIG. 3 is schematic and exemplary only; the shape of any actual curve may vary from the illustration.

According to one embodiment of the invention, the speed at which the elastomeric yarn is unwound is based on a predetermined or assumed package relaxation profile, such as a profile provided from the yarn supplier. Each elastomeric yarn has characteristics that affect how the yarn elongates when it is wound onto a bobbin tube and a profile specific to that type of yarn can be generated to describe the change in mass of a given revolution of the yarn as the yarn is wound onto a bobbin tube. The mass of the yarn itself does not change. However, the mass of a given length, e.g. each revolution of the bobbin, may change depending on the amount of tension stored in the yarn. Thus, the amount of tension stored in each revolution can be determined as a function of mass of that revolution. A profile can be generated that describes the general characteristics of that type of elastomeric yarn. This information can then be used to adjust the unwinding speed for the elastomeric yarn bobbin to compensate for the changing tension and to supply the needles with an elastomeric yarn with relatively constant yarn content.

Alternatively, the predetermined profile can be based on a test run of fabric rolls. As shown in column 2 of Table 1 below, a test run was conducted using an expandable pulley at a constant gauge of, for example, 210 mm. Alternatively, a step motor could be used at a constant speed. As shown in column 1, one creeling of elastomeric yarn in the test run produced 31 fabric rolls. One creeling may alternatively produce 1540 fabric rolls, depending on the size of the rolls and the content of the elastomeric yarn in the final knitted fabric. Fabric rolls are typically 20-50 kg, a size that is determined by the space under the knitting dial 16 and ease of operator handling.

The elastomeric yarn content, which is reported in column 3 in Table 1, can be determined according to well known techniques based on the mass of a fabric roll. According to one technique, the elastomeric yarn content can be determined in the finished "greige" fabric (i.e. fabric with processing oils still present) by dissolving the hard yarn or by dissolving the elastomeric yarn out of a small sample piece of fabric and determining the difference between the starting weight and the weight loss. It can also be done in a "mechanical" way by deconstructing or unraveling the fabric. Another technique is to determine the weight of the elastomeric yarn packages or bobbins before putting them on the creel, weighing the packages after finishing one fabric roll and calculating the elastomeric yarn content from the weight loss and the overall weight of the matching greige fabric roll. The preferred method of determining elastomeric yarn content is to remove the mentioned oils from a small 10×10 cm greige fabric sample by boiling it for 10 minutes in water with a small amount soap. The fabric is rinsed with cold water for 1 minute, flattened, air-dried for 24 hours, and then unraveled. The elastomeric yarn weight can thus be determined as a function of the overall weight, which reveals a more accurate elastomeric yarn content.

If the unwinding speed of the elastomeric yarn is kept constant, the elastomeric yarn content will change due to package relaxation as listed in column 4 of Table 1. A positive value in column 4 indicates an increase in elastomeric yarn content. This is determinative of the fact that the yarn content in the corresponding rolls may be higher than expected or desired.

for each of the other rolls to gradually change the gauge from one calculated gauge to the next. For example, if the gauge of the expandable pulley (or the speed of the independent motor) is calculated for the production of rolls 4, 10, 16, 21 and 28, the speed of unwinding can gradually be changed between these rolls so that a smooth transition in speed is achieved. The speed adjustment can be made manually or automatically and may be performed periodically or continuously. A graph of the unwinding speeds from column 6 (not shown) resembles the general shape of FIG. 3.

TABLE 1

Example Using Fabric Roll Elastomeric Yarn Content to Calculate Package Relaxation Profile

| Column 1 Test Run | Column 2 Gauge of expandable pulley | Column 3 Actual elastomeric yarn content % | Column 4 Elastomeric yarn content Change (%) | Column 5 Fabric Production | Column 6 Fabric Production gauge of expandable pulley |
|---|---|---|---|---|---|
| FABRIC ROLL ("Roll") 1 = control | 210 | 7.3 | 0.0 | FABRIC ROLL ("Roll") 1 = control | =210 |
| Roll 2 | 210 | 7.4 | +1.4 | Roll 2 | →209 |
| Roll 3 | 210 | 7.4 | +1.4 | Roll 3 | →208 |
| Roll 4 | 210 | 7.4 | +1.4 | Roll 4 | Calculated →210 − 1.4% →207 |
| Roll 5 | 210 | 7.4 | +1.4 | Roll 5 | →206.5 |
| Roll 6 | 210 | 7.4 | +1.4 | Roll 6 | →206 |
| Roll 7 | 210 | 7.5 | +2.7 | Roll 7 | →205.5 |
| Roll 8 | 210 | 7.5 | +2.7 | Roll 8 | →205 |
| Roll 9 | 210 | 7.5 | +2.7 | Roll 9 | →204.5 |
| Roll 10 | 210 | 7.5 | +2.7 | Roll 10 | Calculated: →210 − 2.7% →204 |
| Roll 11 | 210 | 7.5 | +2.7 | Roll 11 | →203.5 |
| Roll 12 | 210 | 7.5 | +2.7 | Roll 12 | →203 |
| Roll 13 | 210 | 7.5 | +2.7 | Roll 13 | →202.5 |
| Roll 14 | 210 | 7.6 | +4.1 | Roll 14 | →202 |
| Roll 15 | 210 | 7.6 | +4.1 | Roll 15 | →201.5 |
| Roll 16 | 210 | 7.6 | +4.1 | Roll 16 | Calculated: →210 − 4.1% →201 |
| Roll 17 | 210 | 7.6 | +4.1 | Roll 17 | →200.5 |
| Roll 18 | 210 | 7.6 | +4.1 | Roll 18 | →200 |
| Roll 19 | 210 | 7.7 | +5.5 | Roll 19 | →199 |
| Roll 20 | 210 | 7.7 | +5.5 | Roll 20 | →198.5 |
| Roll 21 | 210 | 7.7 | +5.5 | Roll 21 | Calculated: →210 − 5.5% →198 |
| Roll 22 | 210 | 7.7 | +5.5 | Roll 22 | →197.5 |
| Roll 23 | 210 | 7.7 | +5.5 | Roll 23 | →198 |
| Roll 24 | 210 | 7.6 | +4.1 | Roll 24 | →199 |
| Roll 25 | 210 | 7.6 | +4.1 | Roll 25 | →200 |
| Roll 26 | 210 | 7.6 | +4.1 | Roll 26 | →201 |
| Roll 27 | 210 | 7.6 | +4.1 | Roll 27 | →202 |
| Roll 28 | 210 | 7.5 | +2.7 | Roll 28 | Calculated: →210 − 2.7% →204 |
| Roll 29 | 210 | 7.5 | +2.7 | Roll 29 | →206 |
| Roll 30 | 210 | 7.3 | 0.0 | Roll 30 | =210 |
| Roll 31 | 210 | 7.2 | −1.4 | Roll 31 | Calculated: →210 + 1.4% →213 |
| | | | | Extra Roll 32 | Setting determined by user (e.g. 215) |

The data from column 4 of Table 1 can be used to generate the processing parameters for future applications, as shown by way of example in columns 5 and 6 of Table 1. For example, in column 6 with respect to rolls 1, 4, and 10, the change in yarn content from the test run is used to determine the change in the gauge of the expandable pulley for fabric production for those rolls. Thus, at roll 1 the gauge is set to 210. By roll 4, the gauge is reduced by 1.4% to decrease the speed of unwinding. Similarly, roll 10 is produced by reducing the gauge by 2.7%. Similar calculations can be made for rolls 16, 21 and 28. The speed of unwinding can be adjusted If the unwinding speed is controlled to maintain a constant elastomeric yarn content, less elastomeric yarn is wasted and the remaining yarn may be available to make an additional fabric roll. As shown in column 5 in Table 1, an additional fabric roll was able to be produced as a result of reducing the unwinding speed to maintain the constant elastomeric yarn content in previous rolls. Thus, by compensating for package relaxation, yield of the elastomeric yarn can be increased.

A known, assumed, or tested speed profile can therefore be used to achieve more constant elastomeric yarn content in the finished fabric as well as to improve the elastomeric yarn yield. Thus, the circular knitting process is improved by controlling either the expandable pulleys or by inputting the desired unwinding speed profile information into computer 28 and motor 31 that control elastomeric yarn unwinding.

According to a second embodiment of the invention, compensation for a relaxation profile can be achieved by monitoring the tension in a bobbin of elastomeric yarn as it is unwound and adjusting the desired unwinding speed to maintain a constant tension to the needles 18. Preferably, the tension can be measured using a sensitive tension meter, such as one that utilizes low-weight mini ball bearings to detect low level variations in tension (e.g. 0.5 to a few centinewtons). One example of such a meter is the Zivy EL 10 unit available from Zivy Controle of Jouy le Moutier, France. Alternatively, a simple handheld tension monitoring device, such as is available from Hans Schmidt & Co. GmbH of Waldkraiburg, Germany, can be used. The tension meter (not shown) can be inserted at a point between elastomeric bobbins 24 and needles 18 to measure the tension in the yarn as it is delivered to needles 18.

The knitting tension measurements are used to determine the speed of the elastomeric yarn unwinding motor (or gauge of the expandable pulley) in a manner similar to that explained with respect to the first embodiment. As with the first embodiment, the data is used to adjust the speed of unwinding so that the elastomeric yarn content is constant in the finished fabric. However, in the second embodiment, unwinding speed adjustments are made in response to measurements taken in-process, rather than from predetermined values.

The tension measurements and speed adjustment can be made manually or automatically, and may be performed periodically or continuously. The adjustments can be made using expandable pulleys, step motors or a combination thereof. Preferably, a computer-controlled adjustment system automatically and continuously controls the yarn feeder by increasing or decreasing the speed at which the elastomeric yarn is fed to compensate for the measured package relaxation profile. Thus, tension data is fed to the computer 28 and the package relaxation is calculated from this data. Using such actual calculated package relaxation, the computer controls the unwinding speed.

The knitting tension can be measured at as many positions as desirable to produce a high quality fabric. Preferably, at least 10 positions around the circular knit machine are measured for each fabric roll produced to ensure accurate compensation. More preferably, the tension of all of the elastomeric yarns can be measured. This information can be used to adjust the unwinding speed of the elastomeric yarn to compensate for package relaxation and thereby achieve constant yarn content in a finished fabric.

According to a third embodiment of the invention, the compensation profile is based on a database created when the elastomeric yarn was wound onto the bobbin. A characteristic or multiple characteristics can be measured as the yarn is wound onto a bobbin. For example, the revolutions of the bobbin tube, yarn length, mass or tension may be used to determine the package relaxation profile for the specific yarn as it is wound. More particularly, the tension in the yarn can be determined by measuring the mass of the bobbin for a given number of revolutions of the bobbin. A customized compensation profile can be generated for each bobbin and stored on a database. The compensation profile can be used to adjust the unwinding speed of the circular knit machine to maintain a constant yarn content in the finished fabric.

Adjusting the unwinding speed to compensate for package relaxation according to the present invention leads to a more consistent yarn content in the finished fabric. The quality of the fabric is increased due to the decreased deviation in elastomeric yarn content. Less elastomeric yarn is wasted because the feeding speed of the elastomeric yarn is controlled, which results in a better yield of the relatively expensive elastomeric yarn.

The foregoing description illustrates and describes many aspects of the present invention. However, the disclosure shows and describes only the preferred embodiments of the invention; it is to be understood that the invention is capable of use in various other combinations, modifications, and environments and is capable of changes or modifications within the scope of the inventive concept as expressed herein, commensurate with the above teachings, and/or the skill or knowledge in the art of circular knitting. It is also intended that the appended claims be construed to include alternative embodiments.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein.

I claim:

1. A method for circular knitting an elastomeric yarn, comprising:

unwinding elastomeric yarn from a yarn bobbin;

adjusting the speed at which the elastomeric yarn bobbin is unwound to compensate for package relaxation in the elastomeric yarn; and circular knitting the unwound elastomeric yarn wherein the speed at which the elastomeric yarn is unwound is determined according to a predetermined compensation profile for the elastomeric yarn; and the predetermined profile is determined by measuring a characteristic of a fabric made by knitting the elastomeric yarn with a companion yarn.

2. The method of claim 1, wherein the characteristic is based on the elastomeric yarn content in the fabric.

3. The method of claim 1, wherein the predetermined compensation profile for the elastomeric yarn is entered as input into a computer, and wherein the computer controls the unwinding speed.

4. The method of claim 1, further comprising measuring a characteristic of the elastomeric yarn as the elastomeric yarn is unwound.

5. The method of claim 4, wherein the package relaxation compensation is determined from the measured characteristic and is entered as input into a computer and the computer controls the unwinding speed.

6. The method of claim 5, wherein the characteristic is tension.

7. The method of claim 6, wherein the tension in the elastomeric yarn is measured continuously as the yarn is unwound from the bobbin.

8. The method of claim 1, wherein the speed at which the elastomeric yarn is unwound from the bobbin is determined according to a predetermined compensation profile calculated from the mass of the elastomeric yarn as the elastomeric yarn is wound onto the bobbin.

9. The method of claim 8, wherein the predetermined compensation profile for the elastomeric yarn is entered as input into a computer, and wherein the computer controls the unwinding speed.

10. The method of claim 1, wherein the elastomeric yarn is unwound by an independent motor that can be computer controlled to adjust the unwinding speed.

11. The method of claim 1, wherein the unwinding of the elastomeric yarn is driven by an expandable pulley connected to a drive motor.

12. A circular knitting apparatus comprising:

a knitting dial;

needles associated with the knitting dial;

a creel portion including elastomeric yarn bobbins and companion yarn bobbins to deliver elastomeric yarn and companion yarn to the needles for circular knitting; and a computer that controls the speed at which the elastomeric yarn is unwound to compensate for the package relaxation profile in the elastomeric yarn wherein the computer controls at least one motor that unwinds the elastomeric yarn; and the computer further controls at least one independent motor that unwinds the companion yarn, and wherein said independent motor is driven independently from the motor that unwinds the elastomeric yarn.

13. The apparatus of claim 12, wherein the computer is programmed with a predetermined package relaxation profile for the elastomeric yarn.

14. The apparatus of claim 12, further comprising a tension measurement device to measure the tension of the elastomeric yarn as it is unwound, so that a package relaxation profile for the elastomeric yarn may be calculated.

* * * * *